United States Patent [19]

Schonmeier

[11] 4,438,889

[45] Mar. 27, 1984

[54] SYSTEM FOR DECELERATING THE DRIVE OF A WEB-WINDING APPARATUS

[75] Inventor: Herbert Schonmeier, Dusseldorf, Fed. Rep. of Germany

[73] Assignee: Jagenberg Werke AG, Dusseldorf, Fed. Rep. of Germany

[21] Appl. No.: 339,214

[22] Filed: Jan. 13, 1982

[30] Foreign Application Priority Data

Jan. 17, 1981 [DE] Fed. Rep. of Germany ..... 3101360

[51] Int. Cl.[3] ..... B65H 17/12; B65H 25/32

[52] U.S. Cl. ..... 242/67.1 R; 242/36; 242/57; 242/75.51; 242/78; 72/8

[58] Field of Search ..... 242/67.1 R, 57, 55, 242/75.51, 78, 78.1, 36, 39; 72/8, 14

[56] References Cited

U.S. PATENT DOCUMENTS

| | | | |
|---|---|---|---|
| 2,968,451 | 1/1961 | Schneider | 242/75.51 |
| 3,151,507 | 10/1964 | Canova et al. | 242/75.51 X |
| 3,161,365 | 12/1964 | Johnson et al. | 242/57 |
| 3,208,683 | 9/1965 | Thompson | 242/57 |
| 3,214,110 | 10/1965 | Ross | 242/75.51 X |
| 3,421,708 | 1/1969 | Nicholson et al. | 242/57 |
| 3,518,857 | 7/1970 | Hancock et al. | 242/57 X |
| 3,553,992 | 1/1971 | Harbaugh | 242/57 X |

*Primary Examiner*—Stanley N. Gilreath

*Attorney, Agent, or Firm*—Sprung, Horn, Kramer & Woods

[57] ABSTRACT

A process for decelerating the drive of a web-winding apparatus including a yardage counter for the wound web and a speedometer for the web to be wound, comprising setting a computer for the nominal length of the web which computer, on the basis of the nominal length and of the instantaneous web speed, causes the drive to slow down to a standstill with a preset degree of deceleration; comparing said degree of deceleration with two different curves of which one would result in the nominal length of the web being undershot while the other would result in its being overshot if either curve alone were effective after deceleration has been initiated; and by means of the computer resetting the degree of deceleration on the basis of said two curves and switching from one to the other whenever the instantaneous degree of deceleration indicates the nominal length would be undershot or overshot.

3 Claims, 2 Drawing Figures

SYSTEM FOR DECELERATING THE DRIVE OF A WEB-WINDING APPARATUS

BACKGROUND OF THE INVENTION

The invention relates to a system for decelerating the drive of a web-winding apparatus comprising a yardage counter for the wound web and a speedometer for the web to be wound.

In the winding of a web of material, it is sought to obtain a roll of a length that is as close as possible to the nominal length. If the web on the roll is less than the nominal length, the customer will complain; and if it exceeds the nominal length, the vendor sustains a loss.

Operators of a winding apparatus try to come as close as possible to the nominal length by setting the start of deceleration on the basis of the instantaneous winding speed and of the possible degree of deceleration of the drive when a given web length is reached. Obviously, this approach will not permit the nominal length to be reached with the desired accuracy. Besides, no allowance is made for variables.

SUMMARY OF THE INVENTION

The invention has as its object to provide a system for decelerating the drive of a web-winding apparatus which permits the exact nominal length of a web to be obtained every time.

In accordance with the invention, this object is accomplished by means of a system of the type mentioned above in that there is provided a computer which can be set for the nominal length of the web and which on the basis of the nominal length and of the instantaneous web speed causes the drive to slow down to a standstill with a preset degree of deceleration; that said degree of deceleration is determined by two different curves, one of which would result in the nominal length of the web being undershot while the other would result in its being overshot if either curve alone were effective after deceleration has been initiated; and that the computer keeps resetting the degree of deceleration on the basis of said curves, switching from one to the other whenever it determines that with the instantaneous degree of deceleration the nominal length would be undershot or overshot.

With such a system, the nominal length will be obtained with the desired accuracy. The accuracy will be a function of the processing time of the computer. The shorter the individual deceleration phases based on either curve are, the higher the accuracy with which the nominal length can be obtained.

In accordance with one characteristic of the invention, the computer is inhibited from recomputing the length and comparing it with the nominal length, or from transmitting a switchover command, until the drive has been decelerated with the preset degree of deceleration.

BRIEF DESCRIPTION OF THE DRAWING

The invention will now be described in greater detail with reference to an embodiment illustrated in the accompanying drawing, wherein.

DETAILED DESCRIPTION OF THE INVENTION

Figure 1:
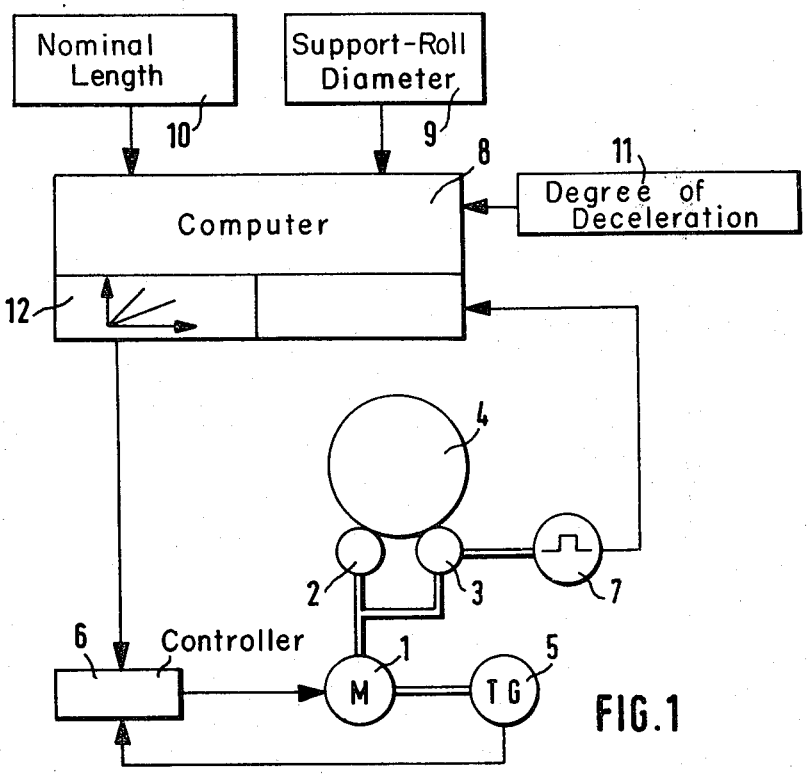
FIG. 1 is a block diagram of a system for decelerating the drive of a web-winding apparatus.

A motor drive 1 drives two support rolls 2 and 3 for a roll 4 being wound. The motor further drives a tachogenerator 5 which delivers a speed signal to a controller 6. The support rolls 2 and 3 drive a pulse generator 7 which delivers a pulse sequence to a computer 8. The diameter of the support roll 3 is entered through a control element 9 as an initial quantity in the computer 8 to enable the latter to compute both the speed and the wound length of the web. Through a further control element 10, the nominal length of the web is entered in the computer. At a third control element 11, two different degrees of deceleration are entered in the computer 8. The output of the computer 8 delivers to the controller 6 a desired value.

The principle of operation of the system in accordance with the invention is as follows:

After the drive has been switched on, the web is accelerated until the speed $V_1$ is reached. This speed is maintained for an indefinite period of time. From the outset, counting pulses are delivered by the pulse generator 7 to the computer 8 and by the latter converted, on the basis of the support roll diameter entered therein, to the instantaneous length of the wound web roll and compared with the preset nominal length. The computer 8 further converts the pulse sequence from the pulse generator 7 into the web speed. This speed determines the difference between the nominal length and the length at which the computer 8 must deliver a signal to the controller 6 for deceleration of the drive 1. However, the degrees of deceleration preset at the control element 11 also enter into the computation of the point at which the decelerating signal is triggered. When the average value of the degrees of deceleration is small, the trigger point should be moved up as far as possible, whereas with a large degree of deceleration it can be moved closer to the nominal length.

Figure 2:
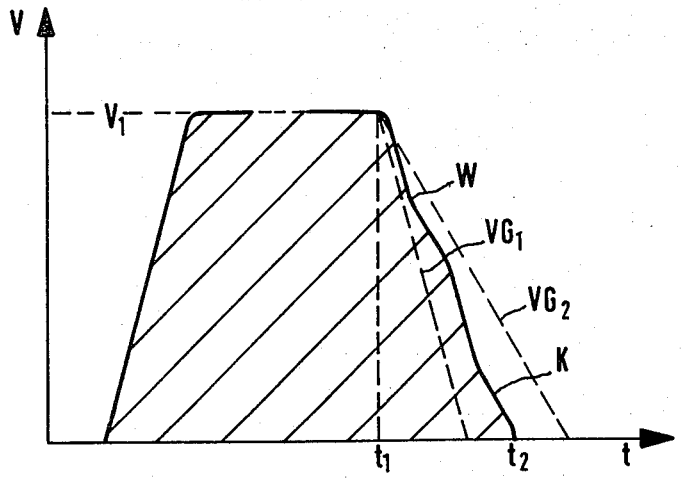
FIG. 2 is a graph plotting the winding speed.

By the time $t_1$, the computer 8 has received from the pulse generator 7 that number of pulses which corresponds to the web length at which deceleration of the drive must be initiated in order that the nominal length may be reached. Through an integrator 12, the computer 8 then delivers to the controller 6 a desired value corresponding, for example, to the degree of deceleration $VG_1$ in FIG. 2. After a dead time, the drive 1 is braked with the degree of deceleration $VG_1$ indicated in FIG. 2. In that figure, this is expressed by the parallel-running initial top portion of the curve K for the web speed. Since the computer 8 continues to receive pulses from the pulse generator 7, it is able to compute the web length that would be reached if deceleration were to continue without a change in the degree of deceleration. With the degree of deceleration in effect over the initial portion, the nominal length would not be reached. The computer therefore switches over to the other, lower degree of deceleration $VG_2$. The changeover time is indicated in FIG. 2 by the knee W in the speed curve K. Over the second portion, the speed curve K extends parallel to the curve of the degree of deceleration $VG_2$. If deceleration were to continue with the degree of deceleration $VG_2$, the nominal length would be exceeded. The computer therefore switches back to the higher degree of deceleration $VG_1$. As a result of these changeovers to different degrees of deceleration, the point aimed at is reached with a high degree of accuracy at $t_2$, where the nominal length is present.

Since the area which in FIG. 2 is hatched is a measure of the length of the web wound, the smoother the curve K the higher will be the accuracy of the delivered length. In practice, the nonlinearity of the curve can be kept to a minimum through a rapid changeover sequence. The pronounced nonlinearity of the curve in FIG. 2 was chosen for the sake of clarity. The lower limit for the changeover times is dependent on the dead time and response time of the drive. The new web length with a given degree of deceleration can, of course, be computed accurately only after that degree has become fully operative. The exact time when such computation is to be performed can be fixed by means of a timing circuit or a comparator for the degree of deceleration set and the deceleration in effect.

It will be appreciated that the instant specification and claims are set forth by way of illustration and not of limitation, and that various changes and modifications may be made without departing from the spirit and scope of the present invention.

I claim:

1. In a process for winding a web to obtain a desired nominal length, wherein the drive of the web winding apparatus is decelerated to a standstill, the improvement wherein the step of decelerating comprises: selecting a desired nominal length of the web, determining the instantaneous web speed; and decelerating the drive, at a time determined as a function of the selected nominal length and the instantaneous web speed, with a preset degree of deceleration obtained from two differenct curves of deceleration, one of which would result in the nominal length of the web being undershot, while the other would result in its being overshot if either curve alone were effective upon initiation of deceleration, continuously determining the instantaneous degree of deceleration and switching between said two curves whenever the instantaneous degree of deceleration indicates the nominal length would be undershot or overshot.

2. A process according to claim 1, wherein the switching between the two curves is delayed by a preselected time.

3. In a web winding apparatus for winding a web to obtain a desired nominal length and having a drive and means for decelerating the drive to a standstill, the improvement wherein the decelerating means includes means for determining the instantaneous web speed, and means for decelerating the drive at a preset degree of deceleration at a time determined as a function of the desired nominal length and the instantaneous web speed including means for continuously determining the instantaneous degree of deceleration and means for switching between two different deceleration curves on the basis of the instantaneous degree of deceleration, wherein one curve would result in the nominal length of the web being undershot and the other curve would result in the nominal length of the web being overshot if either curve alone were effective upon initiation of deceleration.

* * * * *